US008348509B2

(12) United States Patent
Wilkes et al.

(10) Patent No.: US 8,348,509 B2
(45) Date of Patent: Jan. 8, 2013

(54) FLEXIBLE CONTAINER WITH FITMENT AND HANDLE

(75) Inventors: Kenneth R. Wilkes, Asheville, NC (US); Frederic W. Schuldt, Weaverville, NC (US)

(73) Assignee: Smart Bottle, Inc., Asheville, NC (US)

( * ) Notice: Subject to any disclaimer, the term of this patent is extended or adjusted under 35 U.S.C. 154(b) by 319 days.

(21) Appl. No.: 12/565,177

(22) Filed: Sep. 23, 2009

(65) Prior Publication Data

US 2011/0069908 A1 Mar. 24, 2011

Related U.S. Application Data

(60) Provisional application No. 61/241,213, filed on Sep. 10, 2009.

(51) Int. Cl.

| | |
|---|---|
| ***B65D 33/08*** | (2006.01) |
| ***B65D 33/06*** | (2006.01) |
| ***B65D 33/16*** | (2006.01) |
| ***B65D 30/20*** | (2006.01) |

(52) U.S. Cl. ..... 383/10; 383/16; 383/80; 383/120; 383/906

(58) Field of Classification Search ..... 383/10, 383/16, 21, 25, 80, 120, 906
See application file for complete search history.

(56) References Cited

U.S. PATENT DOCUMENTS

| | | | |
|---|---|---|---|
| 302,219 | A | 7/1884 | Andrews |
| 860,183 | A | 7/1907 | Barr |
| 1,596,355 | A | 8/1926 | Hirsch |
| 1,623,107 | A | 4/1927 | Goodykoontz |
| 2,072,225 | A | 3/1937 | Slater |
| 3,206,105 | A | 9/1965 | Smith |
| 3,306,327 | A | 2/1967 | Ilg |
| 3,367,380 | A | 2/1968 | Dickey |
| 3,380,646 | A | 4/1968 | Doyen et al. |
| 3,484,037 | A | 12/1969 | Kugler |
| 4,320,789 | A | 3/1982 | Martin et al. |
| 4,454,979 | A | 6/1984 | Ikeda et al. |
| 4,467,588 | A | 8/1984 | Carveth |
| 4,484,351 | A | 11/1984 | de Leeuwe et al. |
| 4,873,100 | A | 10/1989 | Dirksing et al. |
| 4,911,562 | A | 3/1990 | Mazzeschi |
| 5,050,742 | A | 9/1991 | Muckenfuhs |
| 5,334,180 | A | 8/1994 | Adolf et al. |
| 5,338,117 | A | 8/1994 | Kucksdorf et al. |

(Continued)

FOREIGN PATENT DOCUMENTS

| | | |
|---|---|---|
| GB | 2456550 | 7/2009 |

(Continued)

OTHER PUBLICATIONS

Web pages downloaded from Flexible Jug website at www.flexiblejug.com, copyright 2007-2008.

(Continued)

*Primary Examiner* — Jes F Pascua

(57) ABSTRACT

A flexible container includes a panel structure of flexible web material. The panel structure defines a pouch that has a top opening. A rigid fitment, in the top opening, has a surface section adjoining the pouch. The panel structure defines a handle. The pouch is configured to be carried by the handle in an upright orientation in which the handle projects upward from the pouch at a juncture that is not above the bottom of the pouch-adjoining surface section of the fitment.

5 Claims, 11 Drawing Sheets

U.S. PATENT DOCUMENTS

| | | | | |
|---|---|---|---|---|
| 5,406,650 | A | 4/1995 | Einbinder | |
| 5,624,048 | A | 4/1997 | Sander et al. | |
| 5,637,167 | A | 6/1997 | Krshnakumar et al. | |
| 5,685,454 | A | 11/1997 | Bonerb | |
| 5,758,473 | A | 6/1998 | Patelli | |
| 5,782,562 | A | 7/1998 | Anspacher | |
| 5,918,984 | A | 7/1999 | LaFleur et al. | |
| 6,276,579 | B1 | 8/2001 | DeLoach | |
| 6,287,289 | B1 | 9/2001 | Niedospial | |
| 6,447,165 | B1 | 9/2002 | Grewe | |
| 6,549,744 | B2 | 4/2003 | Terazawa et al. | |
| 6,695,757 | B2 | 2/2004 | Edwards et al. | |
| 6,746,388 | B2 | 6/2004 | Edwards et al. | |
| 6,832,852 | B2 | 12/2004 | Wilkes | |
| 7,147,597 | B2 | 12/2006 | Wilkes | |
| 7,350,657 | B2 | 4/2008 | Eaton et al. | |
| 7,407,326 | B2 | 8/2008 | Wilkes | |
| D608,656 | S | 1/2010 | Wilkes et al. | |
| 8,231,029 | B2 * | 7/2012 | Peer et al. | 220/754 |
| 2003/0059130 | A1 | 3/2003 | Yoneyama et al. | |
| 2003/0202719 | A1 | 10/2003 | Wilkes | |
| 2005/0053313 | A1 | 3/2005 | Lucas et al. | |
| 2006/0257057 | A1 | 11/2006 | Andersen | |
| 2007/0036471 | A1 | 2/2007 | Anasis et al. | |
| 2007/0047851 | A1 | 3/2007 | Sato et al. | |
| 2007/0297700 | A1 | 12/2007 | Berman | |
| 2008/0085065 | A1 | 4/2008 | Nowak et al. | |
| 2008/0277308 | A1 | 11/2008 | Simhaee | |
| 2009/0097779 | A1 | 4/2009 | Branch | |
| 2009/0101699 | A1 | 4/2009 | Goudreau et al. | |

FOREIGN PATENT DOCUMENTS

| | | | | |
|---|---|---|---|---|
| JP | 09-10445 | | | 4/1997 |
| JP | 10059385 | A | * | 3/1998 |
| JP | 10278947 | A | * | 10/1998 |
| JP | 11049186 | A | * | 2/1999 |
| JP | 2000103439 | A | * | 4/2000 |
| JP | 2001114304 | A | * | 4/2001 |
| JP | 2001158443 | A | * | 6/2001 |
| JP | 2001240076 | A | * | 9/2001 |
| JP | 2001348065 | A | * | 12/2001 |
| JP | 2002211588 | A | * | 7/2002 |
| JP | 2002211590 | A | * | 7/2002 |
| JP | 2003191967 | A | * | 7/2003 |
| JP | 2004168341 | A | * | 6/2004 |
| JP | 2005212884 | A | * | 8/2005 |
| JP | 2006001566 | A | * | 1/2006 |
| JP | 2006176138 | A | * | 7/2006 |
| JP | 2009137601 | A | * | 6/2009 |
| WO | WO 9008704 | A2 | * | 8/1990 |
| WO | WO 03/018416 | | | 3/2003 |
| WO | WO 2004054888 | A1 | * | 7/2004 |

OTHER PUBLICATIONS

Picture of a prior art flexible bottle, downloaded from Smart Bottle, Inc. website at www.smartbottleinc.com.

International Search Report and Written Opinion issued May 3, 2010 for PCT Application No. PCT/US2010/25339.

International Search Report and Written Opinion issued May 3, 2010 for PCT Application No. PCT/US2010/25348.

Office Action issued Jan. 19, 2012 by USPTO for U.S. Appl. No. 12/712,544.

* cited by examiner

FLEXIBLE CONTAINER WITH FITMENT AND HANDLE

CROSS-REFERENCE TO RELATED APPLICATION

This application claims the benefit of U.S. Provisional Application No. 61/241,213, filed Sep. 10, 2009, hereby incorporated herein by reference.

TECHNICAL FIELD

This relates to a flexible container with a fitment and a handle.

BACKGROUND

A flexible container can be used to contain a liquid. The container includes flexible panels of plastic sheet material that are adjoined together along their edges to form a pouch with a top opening. A rigid fitment is sealed into the pouch's top opening. A channel in the fitment provides access to the interior of the pouch for filling and emptying the pouch. The fitment has an external screw thread by which a bottle cap is screwed onto the fitment to seal off the container.

SUMMARY

A flexible container includes a panel structure of flexible web material. The panel structure defines a pouch that has a top opening. A rigid fitment, in the top opening, has a surface section adjoining the pouch. The panel structure defines a handle. The pouch is configured to be carried by the handle in an upright orientation in which the handle projects upward from the pouch at a juncture that is not above the bottom of the pouch-adjoining surface section of the fitment.

Preferably, the juncture is below the pouch-adjoining surface section of the fitment, and even below the bottom of the fitment. The juncture is one of four junctures, below the pouch-adjoining surface section, at which the handle projects upward from the pouch. The handle includes a handgrip, and the container lacks a line of weight-supporting material extending continuously downward from the handgrip to the fitment. The juncture is one of four junctures, below the pouch-adjoining surface section, at which the handle projects upward from the pouch. The panel structure includes flexible front and rear panels extending in a lateral direction, and the junctures include two front junctures at laterally opposite sides of the front panel and two rear junctures at laterally opposite sides of the rear panel. The handle includes two front suspensions extending from the two front junctures and two rear suspensions extending from the two rear junctures.

DESCRIPTION

Overview

Figure 1:
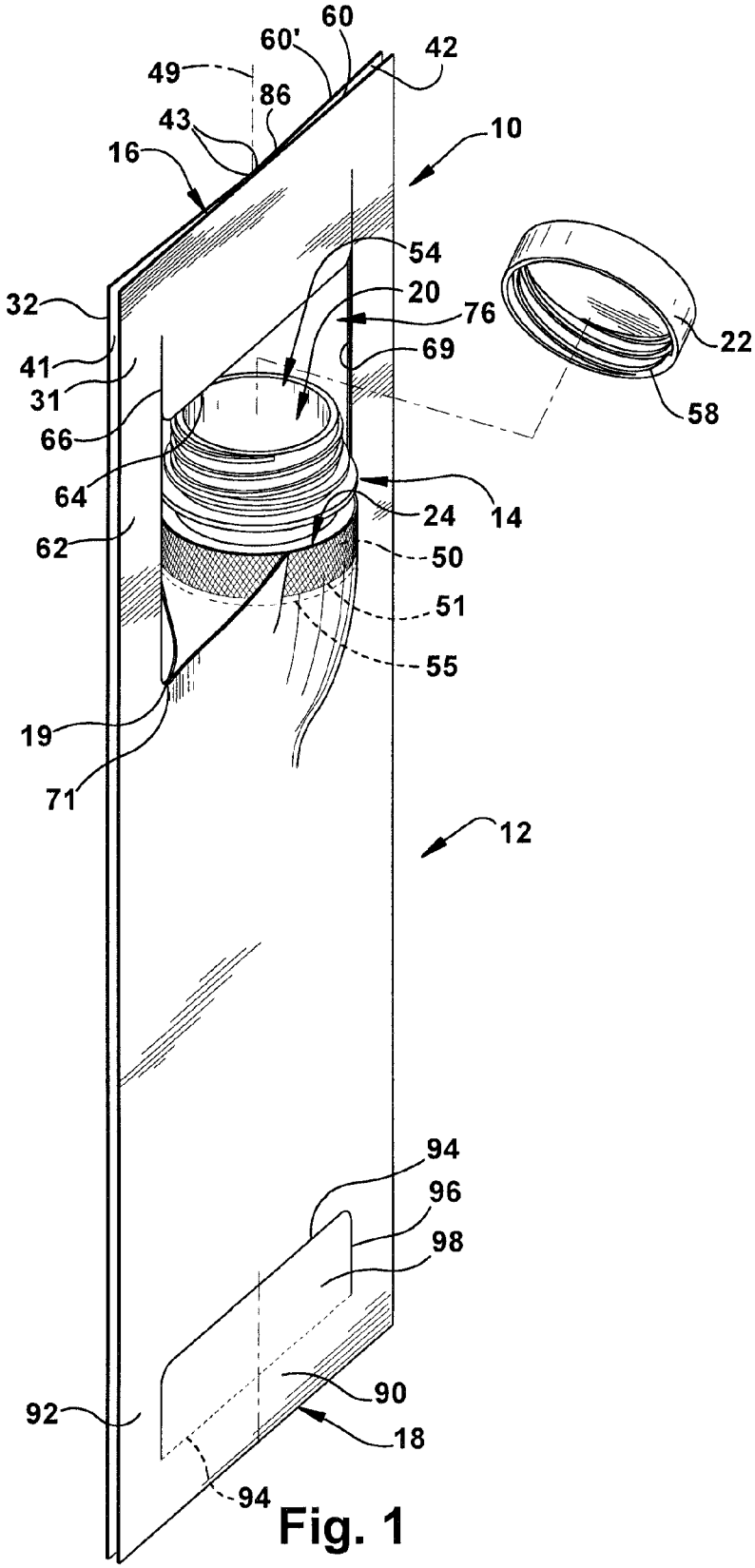
FIG. 1 is a perspective view of a gusseted flexible container shown in an unfilled condition.
Figure 2:
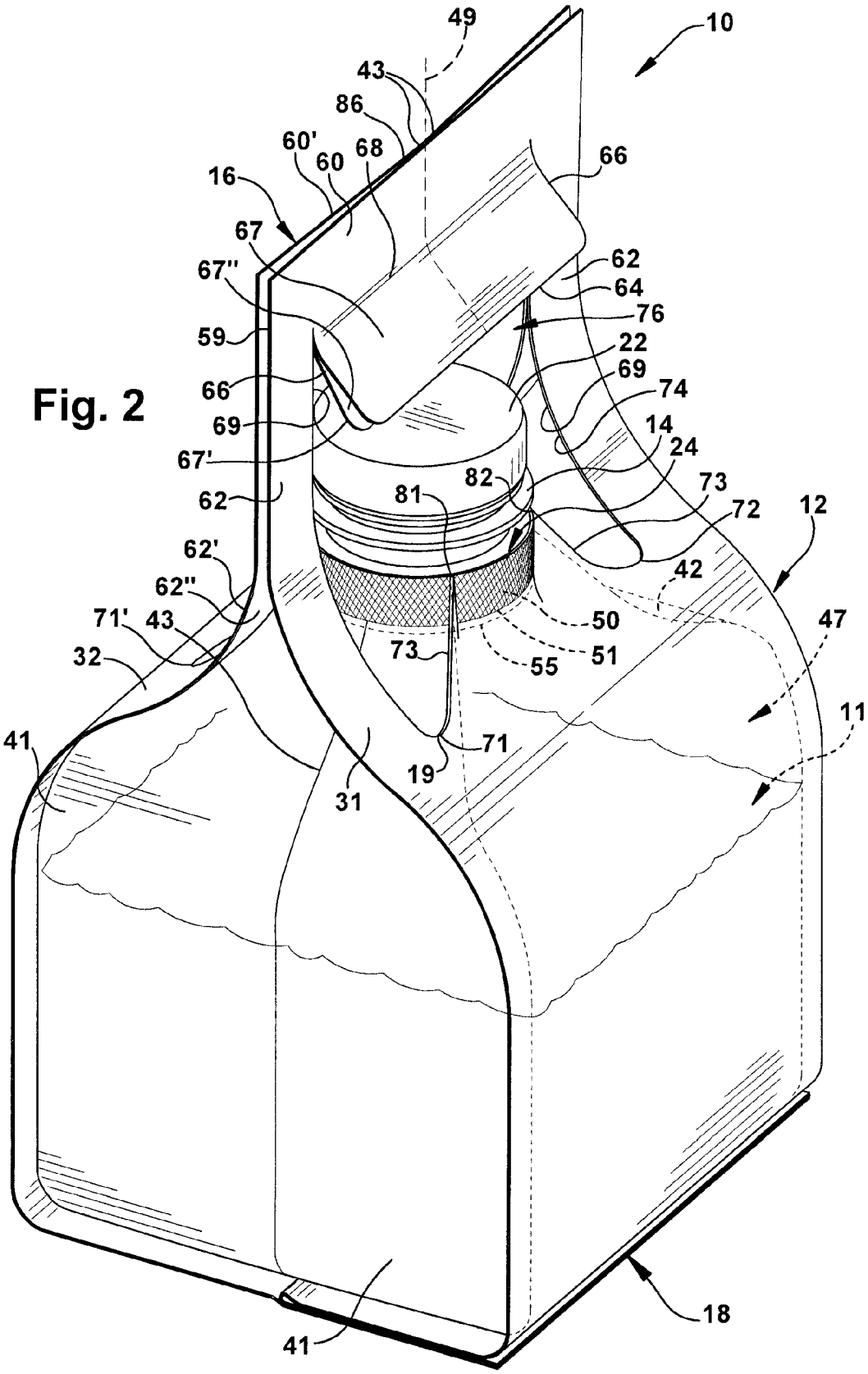
FIG. 2 is a perspective view of the container in a filled condition.

The apparatus shown in FIGS. 1 and 2 has parts that are examples of the elements recited in the claims. The apparatus includes a gusseted container 10 for containing liquid 11 or solids. The container 10 includes a flexible pouch 12, a rigid fitment 14, an upper handle 16 and a lower handle 18. FIG. 1 shows the container 10 in a collapsed, unfilled condition. FIG. 2 shows the container 10 in an expanded, filled condition, achieved by pouring solids or, as in this case, liquid, into the pouch 12 through a channel 20 in the fitment 14. A bottle cap 22 is screwed onto the fitment 14 to close the channel 22 and seal the container 10. The upper handle 16 adjoins the pouch at junctures 19.

In the following description of the container 10, directional terms such as upper, lower, horizontal and vertical are with respect to the container's upright orientation of FIG. 1. "Lateral" is in the horizontal direction when the container 10 is the upright orientation.

Pouch

Figure 3:
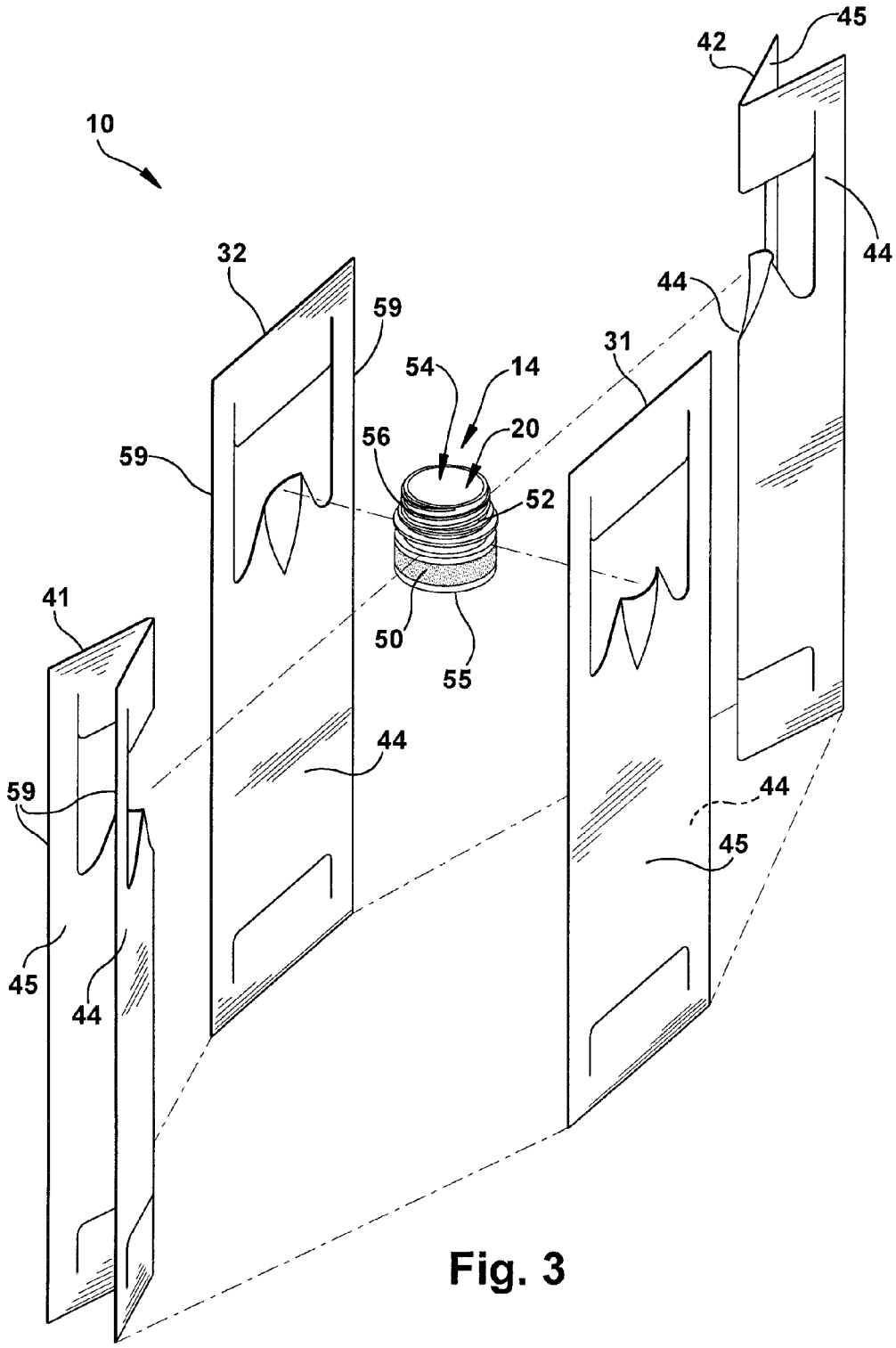
FIG. 3 is an exploded view of the container.

As shown in FIGS. 2-3, the pouch 12 has a top opening 24. The pouch 12 is defined by a flexible panel structure that includes four rectangular panels of flexible web material that are adjoined along their peripheries. The flexible web material is flexible sheet material configured to accept, during its handling and use, repeated folding and unfolding and rolling into rolls and unrolling with insubstantial resistance. Examples of such flexible web material are extruded thin plastic sheet, foil and paper, and laminations thereof. Laminations comprise two or more webs laminated over each other, such as by heat or adhesive. An example two-layer lamination comprises a nylon web laminated on a polyethylene web. An example three-layer lamination comprises a plastic sheet, a foil and a paper laminated over each other. The web's flexibility enables the resulting pouch 10 to be collapsible, in that it is configured to be, during handling and use, repeatedly collapsed into the empty, flattened configuration of FIG. 1 and re-expanded into the filled configuration of FIG. 2.

The panels include front and rear panels 31 and 32 and first and second opposite side panels 41 and 42. Each panel 31, 32, 41, 42 has an inside surface 44 configured to contact the pouch contents 11 and to adjoin to other panels 31, 32, 41, 42, and an outside surface 45 configured to be exposed to the outside air.

Part or all of the front and/or rear panels 31, 32 can be imprinted with illustrations and/or text (not shown) relating to the container's contents 11. The imprinting can render some or all of the front and/or rear panels 31, 32 opaque. The side panels 41, 42 can be completely transparent so the container's contents 11 can be seen from outside the container 10.

FIGS. 4-7 show plan views of the inside surfaces 44 of the front panel 31, the rear panel 32, the first side panel 41 and the second side panel 42, respectively. The inside surface 44 of each panel 31, 32, 41, 42 includes a cavity-bounding section 46 that is configured to bound the container's cavity 47 (FIG. 2) and contact its contents 11.

The inside surface 44 of each panel 31, 32, 41, 42 includes a contiguous series of adjoining sections that surround the cavity-bounding section 46. The adjoining sections are portrayed in FIGS. 4-7 as hatched areas bounded by imaginary dot-dashed lines. Each adjoining section is configured to adjoin a corresponding adjoining section of the fitment 14 or another panel. The adjoining sections of the front panel 31 include a first side adjoining section 31A configured to adjoin a front adjoining section 41F of the first side panel 41. The front panel 31 further includes a second side adjoining section 31B configured to adjoin a front adjoining section 42F of the second side panel 42. The rear panel 32 includes a first side adjoining section 32A configured to adjoin a rear adjoining section 41R of the first side panel 41. The rear panel 32 further includes a second side adjoining section 32B configured to adjoin a rear adjoining section 42R of the second side panel 42. Each of the panels 31, 32, 41, 42 includes a fitment adjoining section 31C, 32C, 41C, 42C, configured to adjoin the fitment 14.

Adjoining the adjoining sections 31A, 31B, 31C, 32A, 32B, 32C, 41F, 41R, 41C, 42F, 42R, 42C to each other or to the fitment 14 can be done, for example, ultrasonically or through heat and pressure such as with a seaming iron or a hot roller. It can entail, for example, plastic welding, in which the material of one panel melts into the other, or an adhesive or thermoplastic coating applied to one of or both adjoining surfaces.

In the assembled, unfilled condition of the container 10 shown in FIG. 1, each of the front and rear panels 31, 32 lies flat. The side panels 41, 42 are sandwiched between the front and rear panels 31, 32 and are folded in half at respective fold lines 43. The two fold lines 43 meet at the pouch's midline 49, where they are sandwiched between the front and rear panels 31, 32. In the filled condition shown in FIG. 2, the folds 43 are unfolded (opened) along most of their heights. The fold lines 43 are living hinges, configured during use and handling to enable repeated folding and unfolding as the container 10 is repeatedly emptied and collapsed and then filled and expanded.

Fitment

The fitment 14 is shown in FIGS. 2-3. It is rigid and preferably molded as a one-piece component. It includes the channel 20, a pouch-adjoining surface section 50 sealed to the pouch 12 and a spout 52 projecting out of the pouch 12. The channel 20 extends downward from a top opening 54 of the fitment 14 to provide access to the container cavity 47 for filling and emptying the container 10. The pouch-adjoining surface section 50 surrounds the fitment 14. The pouch-adjoining surface section 50 has a bottom 51 that in some examples can coincide with the fitment's bottom 55. The pouch-adjoining section 50 is sealingly adjoined about its full circumference to the fitment-adjoining sections 31C, 32C, 41C, 42C of the pouch panels 31, 32, 41, 42. When the container 10 is assembled, the bottom 51 (FIG. 3) of adjoining section 50 of the fitment 14 coincides with the bottom 51 (FIG. 4) of the adjoining section 31C (FIGS. 3-4) of the front and rear panels 31, 32. The spout 52 has an external screw thread 56. The screw cap 22 (FIG. 1), with an internal screw thread 58, is screwed onto the fitment 14 to seal the container 10.

Upper Handle

As shown in FIGS. 1-2, the upper handle 16 is formed from the same panels 31, 32, 41, 42 that form the pouch 12. Each of the front and rear panels 31, 32 extends along the full horizontal width of the handle 16. Each side panel 41, 42 extends from a peripheral edge 59 of the handle 16 laterally inward, with the side panels' fold lines 43 meeting at the pouch's midline 49.

Figure 4:
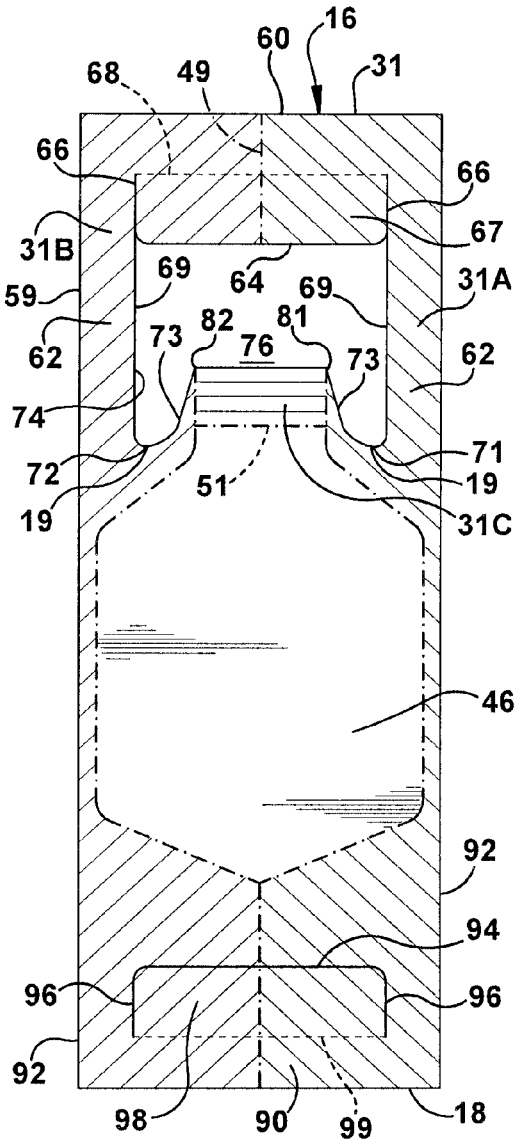
FIGS. 4-7 are respective plan views of a front panel, a rear panel, a first side panel and a second side panel that are shown in FIG. 3.

FIGS. 2 and 4 show components of the handle 16 that are defined by the front panel 31. These components include a horizontal handgrip structure 60 and two vertical side suspensions 62. The suspensions 62 extend from laterally opposite ends of the handgrip structure 60 downward to the junctures 19 between the suspensions 62 and the pouch 12.

The peripheral edge 59 of the panel 31, and thus of the handle 16, follows three legs of a rectangle. The handgrip structure 60 has a straight horizontal bottom edge 64 and two upward side edges 66 that together define a flap 67. The flap 67 is configured to be bent upward about a horizontal fold line 68 when the handgrip structure 60 is manually grasped, to fold the handgrip structure 60 onto itself to increase its thickness and strengthen.

Two vertical inner edges 69 of the two side suspensions 62 extend from the handgrip structure 60 down to respective lowest locations 71, 72 of the vertical inner edges 69. These lowest locations 71, 72 are at the junctures 19 between the suspensions 62 and the pouch 12. Two inner upturned edges 73 extend from the respective lowest locations 71, 72 upward to the fitment 14.

Figure 6:
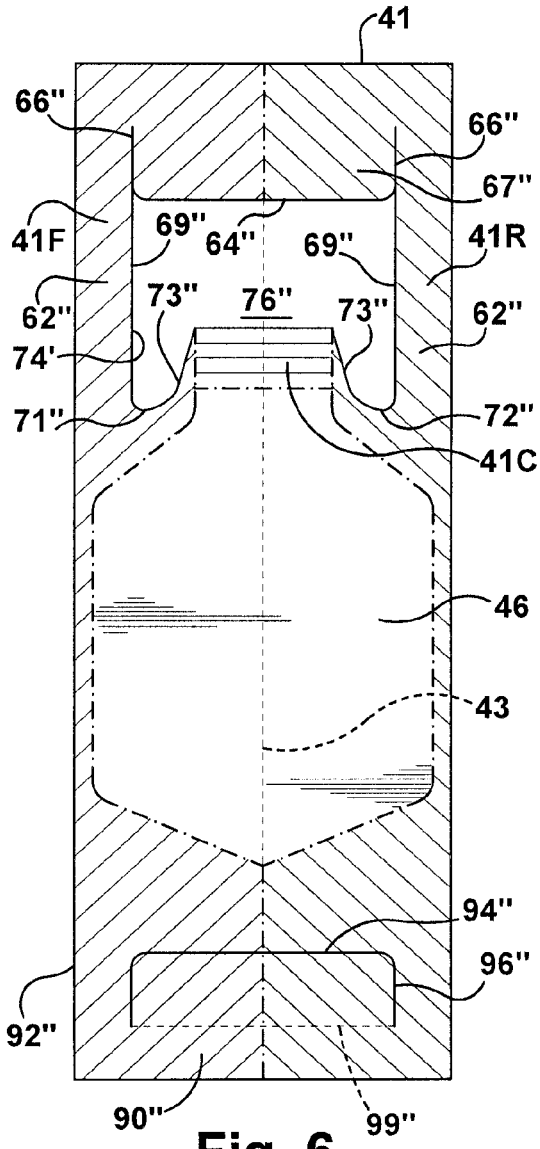
Figure 7:
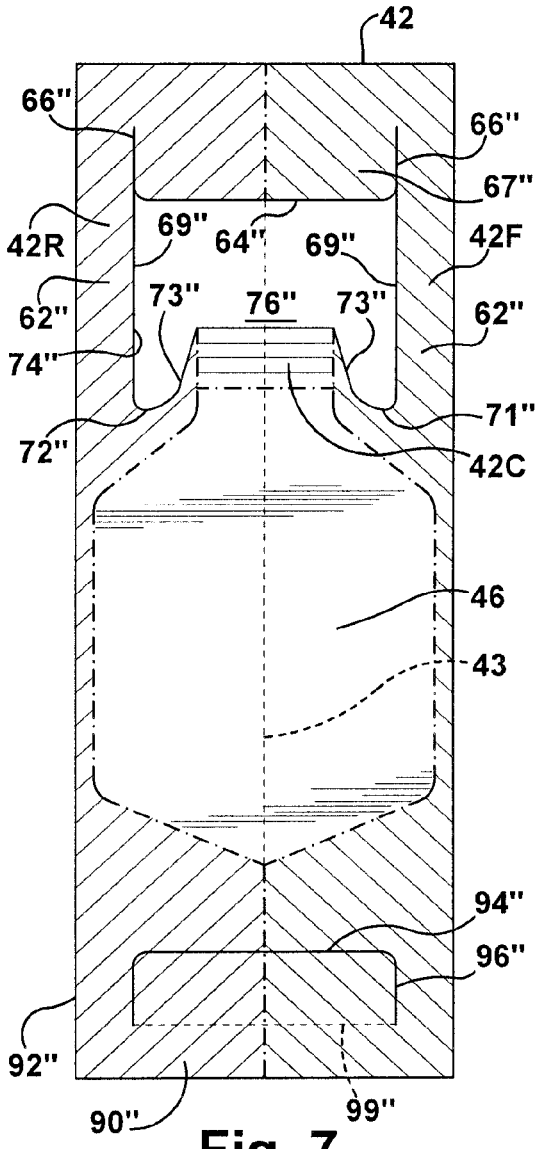

The inner edges 64, 66, 69, 73 of the front panel 31 together comprise an opening edge 74 that defines a panel opening 76 in the front panel 31. The opening edge 74 has a first end 81 at the fitment 14 and an opposite second end 82 at the fitment 14. The two ends 81, 82 are circumferentially spaced about the fitment 14 by about 90 degrees. The opening edge 74, along its entire path, is cut into a double-layer of adjoining sections. Specifically, from its first end 81 to the pouch midline 49, the edge 74 is cut into both the first side adjoining section 31A of the front panel 31 and front adjoining section 41F of the first side panel 41 (FIG. 6). From its second end 82 to the pouch midline 49, the edge 74 is cut into both the second side adjoining section 31B of the front panel 31 and the front adjoining section 42F of the second side panel 42 (FIG. 7). The panel opening 76 laterally separates the two suspensions 62 and bounds the handgrip structure 60 from below.

Figure 5:
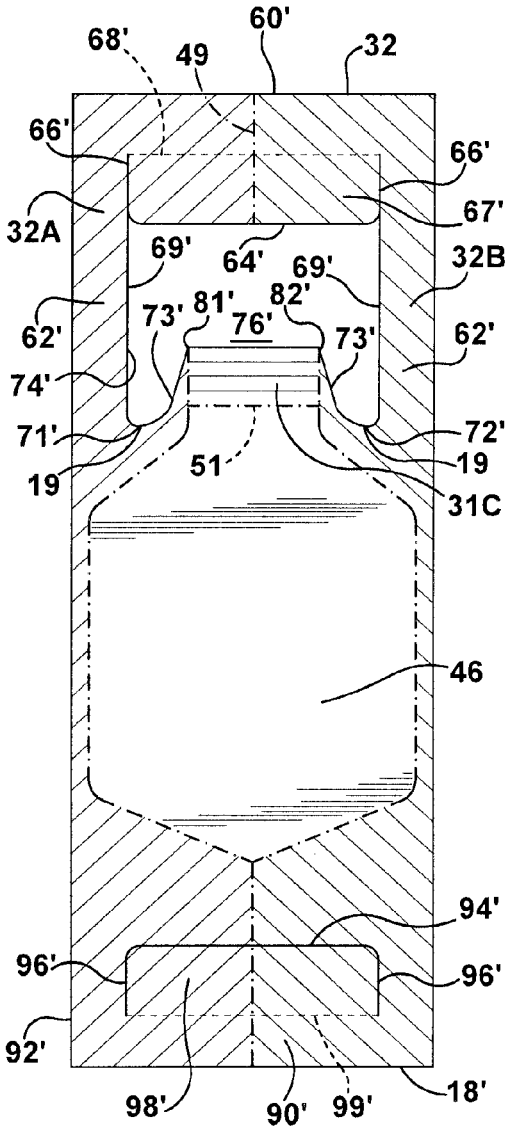

As shown in FIG. 5, the rear panel 32 is substantially a mirror image of the front panel 31. It has features for defining the handle 16 that are substantially identical to those of the first panel 31, and that are designated in FIG. 5 with primed numerals that match those of corresponding features in the front panel 31. Like the front panel 31, the rear panel 41 has an opening edge 74' defining a panel opening 76'. The rear opening edge 74', from its first end 81' to the pouch midline 49, is cut into both the first side adjoining section 32A of the rear panel 32 and the rear adjoining section 41R of the first side panel 41. From its second end 82' to the pouch midline 49, the opening 76' is cut into both the second side adjoining section 32B of the rear panel 32 and the rear adjoining section 42R of the second side panel 42. The first ends 81, 81' of the respective front and rear opening edges 74, 74' are circumferentially spaced about the fitment 14 by about 90 degrees. Similarly, the second ends 82, 82' are circumferentially spaced about the fitment 14 by about 90 degrees.

In this example, as shown in FIG. 2, the handgrip structure 60 of the front panel 16, including its flap 67, adjoins the handgrip structure 60' of the rear panel 32 only along the pouch's midline 49. The front and rear handgrip structures 60, 60' thus form a single bifurcated handgrip 86. In alternative examples, the handgrip structures 60, 60' can be adjoined along all or part of their width and height, and even up to the peripheral edge 59.

When unassembled and laid flat, as in FIGS. 4-7, the side panels 41, 42 are substantially identical to the front and rear panels 31, 32. They have features for defining the handle 16 that match those of the first panel 31, and that are designated in FIGS. 6-7 with double-primed numerals that match those of corresponding features in the front panel 31. However, when assembled as in FIG. 1, each of the side panels 41 differs from the front and rear panels 31, 32 in that it extends laterally only to the pouch midline 49, where its fold 43 abuts the fold 43 of the other side panel. The opening edges 74', 74" of the rear panel 32 and side panels 41, 42 coincide with the opening edge 74 of the front panel 31. One half of the front opening edge 74 of the front panel 31, extending to the pouch midline 49, coincides with the opening edge 74" in the first side panel 41, and the other half of the front opening edge 74 coincides with a matching opening edge 74" in the second side panel 42. The same holds true for the rear opening edge 74'.

The panel openings 76, 76', 76" in the front, rear and side panels 31, 32, 41, 42 are defined by absence of panel material, achieved in any suitable way. When manufacturing the panels 31, 32, 41, 42, the openings can be formed by actually cutting material from the panels after they are formed or can exist in the panels when the panels are first formed.

The upper handle 16 has a special configuration, defined as follows with respect to the front panel 31 in FIGS. 2 and 4, that facilitates folding and use. The panel opening 76 extends laterally over and across the fitment 14 to make room for fingers to extend fully about the handgrip structure 60 directly above the fitment 14 when the container 10 is carried. At laterally opposite sides of the fitment 14, the opening 76 extends down to the respective lowest locations 71, 72, which are not above, and in this example are below, the bottom 51 of the fitment's adjoining section 50 and preferably even the bottom 55 of the fitment 14. Accordingly, the container 10, when suspended by the handle 16, lacks a line of material, supporting the weight of pouch's contents 11, extending continuously downward from the handgrip structure 60 to the fitment 14. That is because any path of material extending from the handgrip structure 60 to the fitment 14 must include an upward leg, such as along the upturn edge 73.

Figure 8:
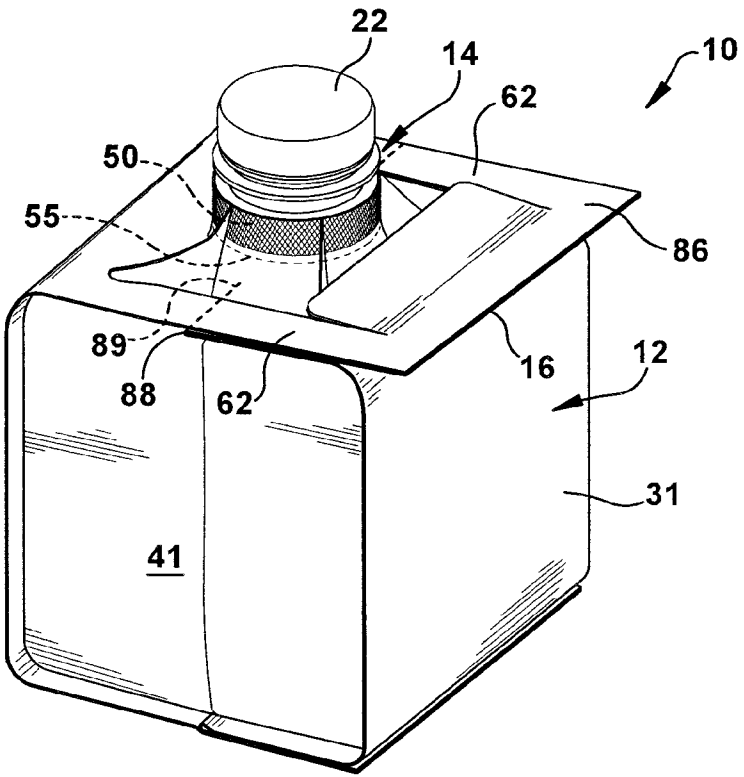
FIG. 8 is a perspective view of the container showing its upper handle folded down while the container rests on a surface.

As shown in FIG. 8, one consequence of this configuration is that it facilitates folding down the handle 16, including its side suspensions 62, to overlie the pouch 12 and remain entirely below the fitment's adjoining section 50 and bottom 55. This is facilitated by the lower panel 32, over which the handle 16 is folded, to have folds 84 at opposite sides of the fitment 14. The folds 88 extend along an imaginary line 89 that underlies the fitment's adjoining section 50 and bottom 55 directly below the center of the fitment 14.

Figure 9:
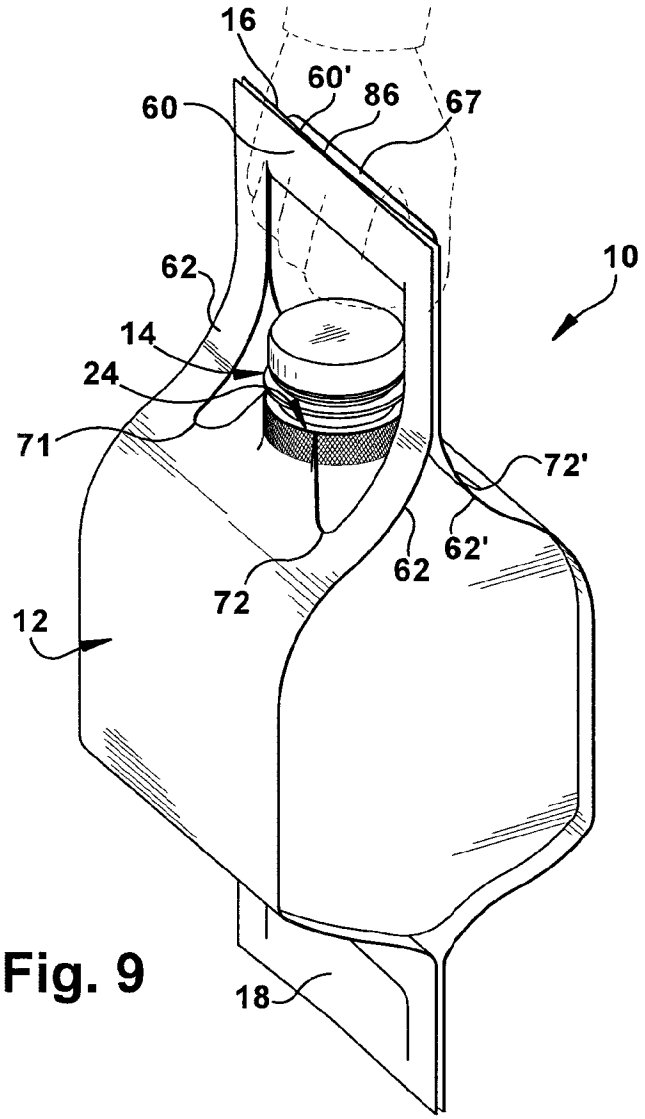
FIG. 9 is a perspective view of the container being carried in an upright orientation.

FIG. 9 shows the container being carried in an upright orientation. The upper handgrip 86 is grasped by a hand fully about the handgrip 86. The fitment's opening 56 (FIG. 1) faces upward. The suspensions 62 extend downward from the handgrip 86. The four junctures between the suspensions 62, 62' and the pouch 12, at the lowest locations 71, 72, 71', 72' of the panel openings 76, 76', together carry the full weight of the pouch's contents.

Even though the fitment 14 is above the pouch 12 and closer to the handgrip 86 than is the pouch 12, lifting the handgrip 86 supports the fitment 14 by way of the flexible pouch 12 beneath it, instead of suspending the pouch 12 by way of the fitment 14. The fitment 14 is thus supported from below by the flexible web material of the pouch 12 which is itself supported from the junctures 19 that are below the fitment 14 and its adjoining section 50.

Lower Handle

Referring to FIG. 1 and FIGS. 4-7, the lower handle 18 comprises a handgrip 90 and two side suspensions 92, having some of the same features as the upper handgrip 16. Specifically, the suspensions 93 extend from opposite ends of the lower handgrip 90 to the cavity-bounding section 46. The lower handgrip 90 is formed from the same sheets 31, 32, 41, 42 that form the pouch 12. The front and rear panels 31, 32 each extend along the full width of the lower handgrip 90, while each side panel 41, 42 extends laterally only to the midline 49, where their folds 43 meet between the front and rear panels 31, 32.

The lower handgrip 90 is formed by a U-shaped slit, cut in all four panels 31, 32, 41, 42, comprising a straight horizontal section 94, 94', 94" and two opposite vertical sections 96, 96', 96" that define a flap 98, 98', 98". The flap 98, 98', 98" is configured to bend about a fold line 99, 99', 99" when the handgrip 90 is manually grasped, to increase its thickness and strengthen.

Figure 10:
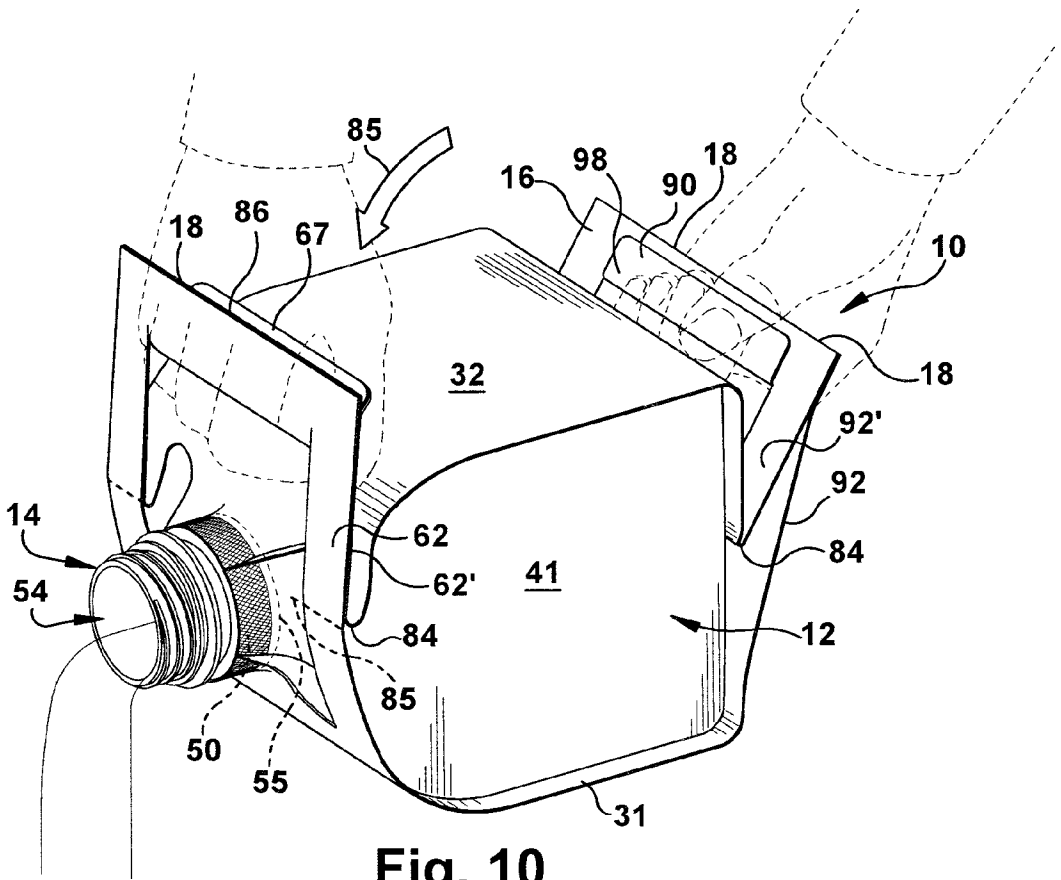
FIG. 10 is a perspective view of the container being suspended in a partially inverted orientation for decanting the container.

FIG. 10 exemplifies a method of decanting the container 10. The upper and lower handgrips 86 and 90 are grasped simultaneously to suspend the pouch 12 in a sideways orientation in which it is partially inverted, with the front panel 31 below the rear panel 32. In the orientation shown, the "upper" and "lower" handgrips 86 and 90 are at about the same level. The suspensions 62 and 92 of the front panel 31 extend downward to together carry the full weight of the liquid in the pouch 12. The suspensions 62' and 92' of the rear panel 32 do not carry the weight of the liquid, but instead are folded. Folds 84 of the top suspensions 62' define an imaginary line 85 that is directly behind the fitment 14, i.e., directly behind the fitment's bottom 55. The entire fitment 14 is therefore beyond the suspensions 62 in a direction away from the lower handle 18. The fitment opening 54 faces horizontally, for the liquid to flow by gravity out from the pouch 12 through the fitment 14. The special configuration described above for the upper handle 86 enables the suspensions 62 to bend more sharply and neatly behind the fitment 14 than if the upper handle 86 lacked this configuration.

Figure 11:
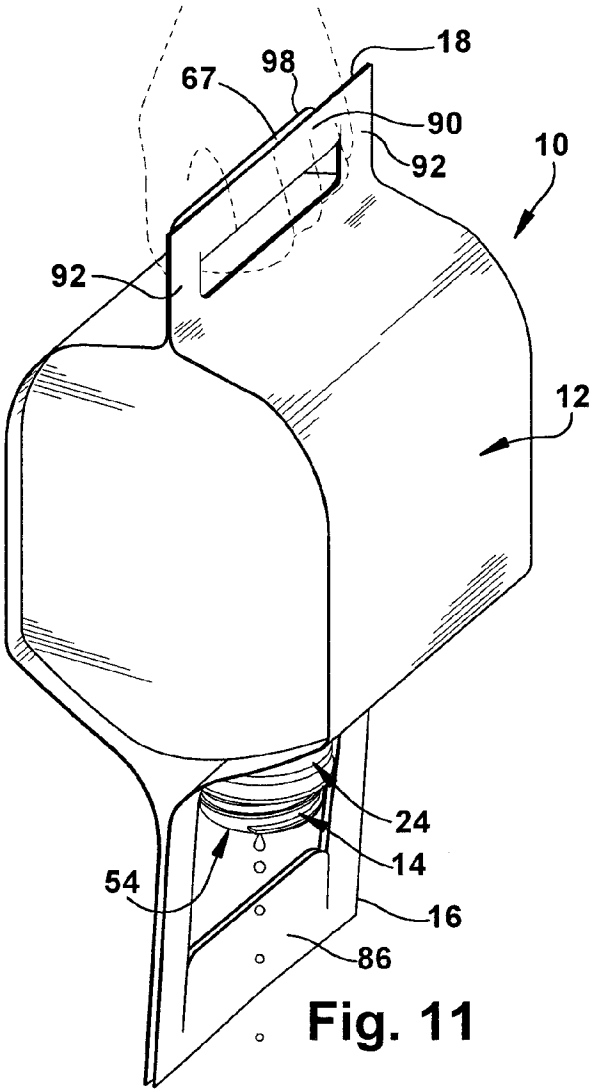
FIG. 11 is a perspective view of the container being suspended in a fully inverted orientation for emptying the container.

FIG. 11 exemplifies a method of completely emptying the container 10. The lower handgrip 90 is manually grasped fully about the lower handgrip 90 to suspend the container 10 upside down in an inverted orientation in which the lower handgrip 90 is above the upper handgrip 86. In this orientation, the pouch opening 24 and the fitment opening 54 face downward away from the lower handgrip 90. Liquid in the pouch 12 flows by gravity out of the pouch 12 through the fitment opening 54. This is especially useful for contents 11 that flow slowly, such as salad dressing and oil.

Other Examples

In the above example of the front and rear panels 31, 32 shown in FIGS. 4-5, the first and second adjoining sections 31A, 31B, 32A, 32B of each of the front and rear panels 31, 32 meet at the pouch's midline 49. This causes the folds 43 in first and second side panels 41, 42 to meet at the midline 49 too. This, in turn, gives the filled container 10 a generally square footprint.

Figure 12:
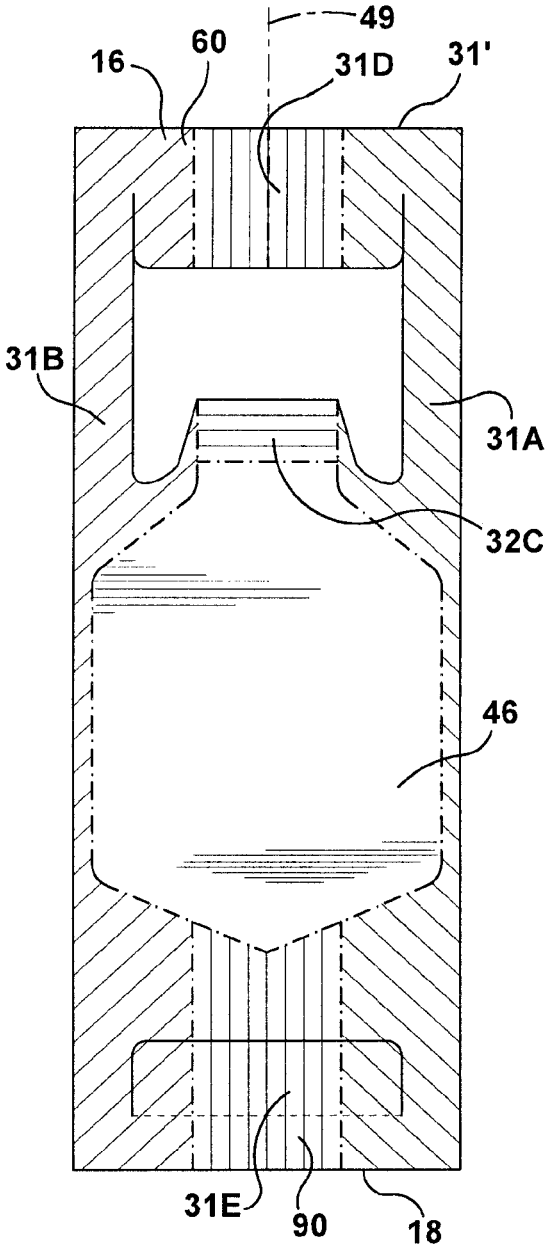
FIGS. 12 and 13 are plan views of alternative front and rear panels.
Figure 13:
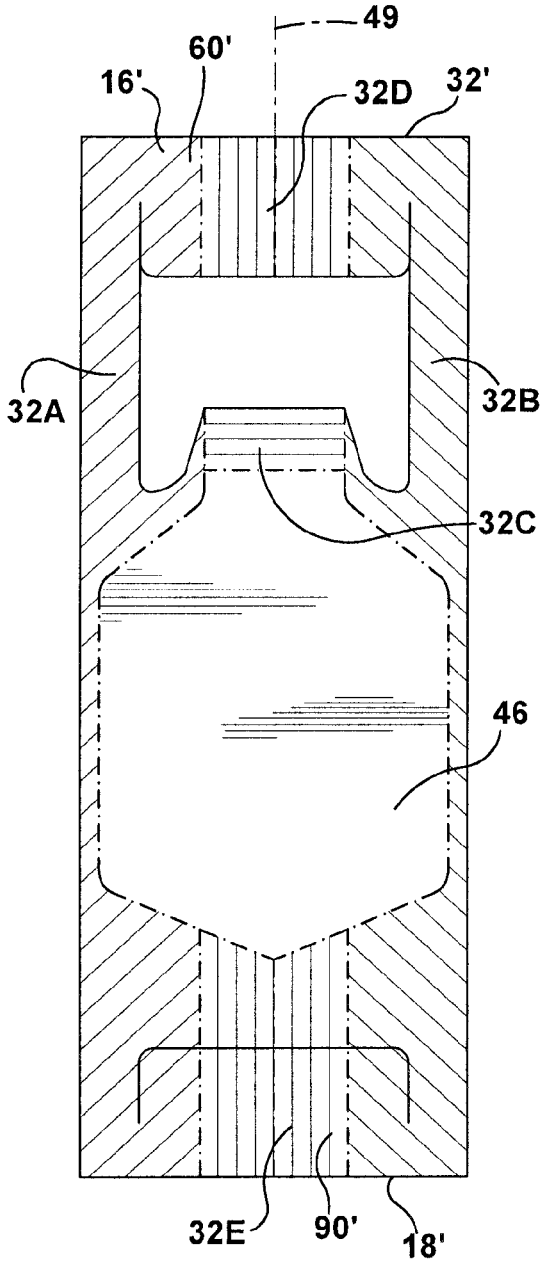

FIGS. 12-13 show alternative front and rear panels 31' and 32'. The first and second adjoining sections 31A, 31B of the first panel 31' are separated by upper and lower central adjoining sections 31D, 31E. Similarly, the first and second adjoining sections 32A, 32B of the second panel 32' are separated by upper and lower central adjoining sections 32D, 32E. When the pouch 12 is assembled, the upper central adjoining sections 31D, 32D are adjoined and the lower central adjoining sections 31E, 32E are adjoined. In that case, the folds 43 (FIG. 1) in the side panels 41, 42 will be spaced laterally from each other. That will give the filled container 10 a generally rectangular footprint that is not square but instead longer laterally (along the front and rear panels 31', 32') and thus longer along the handgrips 60, 60', 90, 90' and shorter along the side panels 41, 42.

Figure 14:
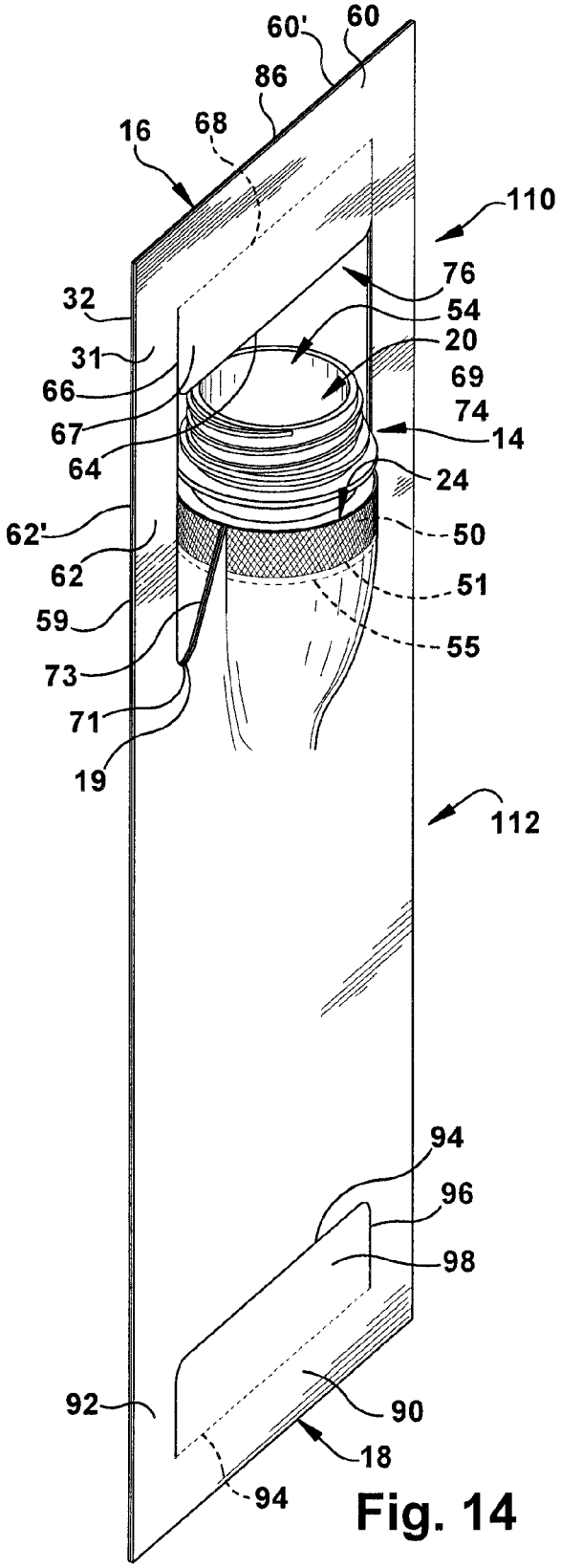
FIGS. 14 and 15 are perspective views of a non-gusseted flexible container shown respectively in an unfilled condition and a filled condition.
Figure 15:
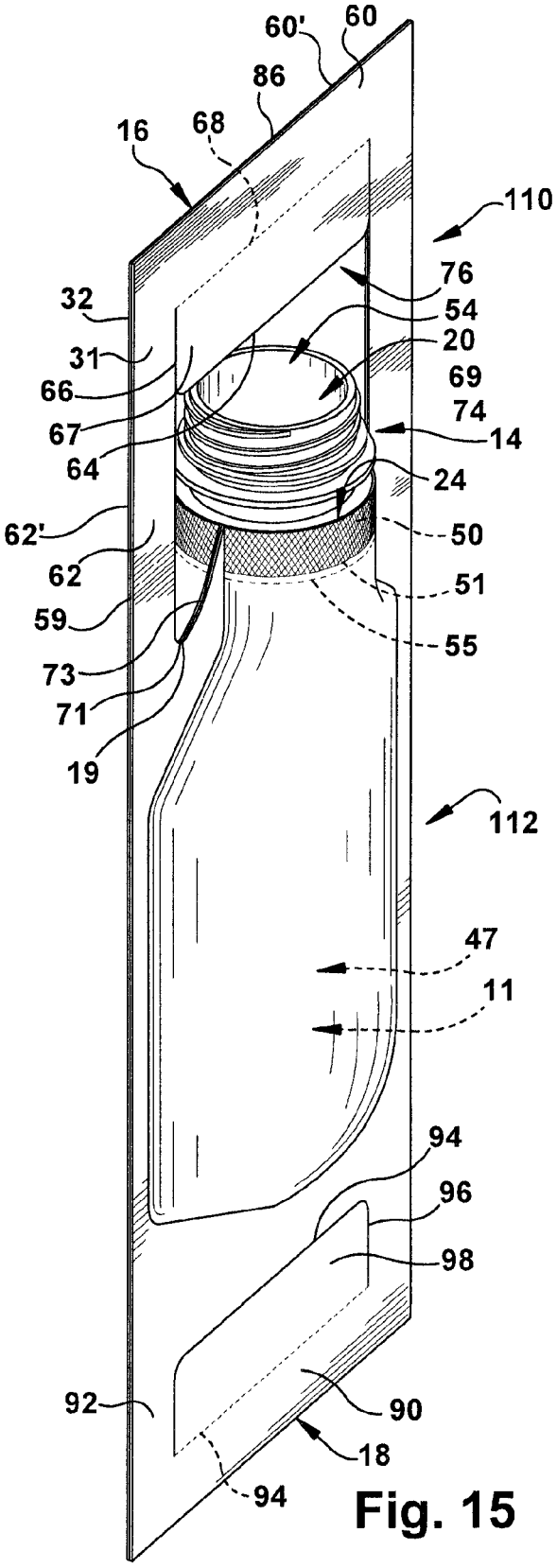

FIGS. 14 and 15 show an alternative container 110 respectively in a flattened, unfilled condition and an expanded, filled condition. This container 110 differs from the previous container 10 in that it is not gusseted. It is instead formed by adjoining the front and rear panels 31, 32 of FIGS. 4-5 directly together, without side panels 41, 42 (FIG. 3) in-between. This is done by adjoining section 31A of the front panel 31 to section 32A of the rear panel 32, and adjoining section 31B of the front panel 31 to section 32B of the rear panel 32. Sections 31C and 32C of the front and rear panels 31, 32 adjoin section 50 (FIG. 3) of the fitment 14. This is thus a non-gusseted container 110, because it has a non-gusseted pouch 112. This is in contrast to the gusseted container 10 of FIGS. 1-2 with its gusseted pouch 12.

The front and rear handgrip structures 60, 60 of this container 110, which form the handgrip 86, can be adjoined together along all or part of their surface areas. Similarly, the front and rear suspensions 62, 62' can be adjoined together along all or part of their surface areas.

The non-gusseted container 110 of FIGS. 14-15 has many of the features of the gusseted container 10 of FIGS. 1-2, for the container 110 to be used and manipulated in the same manner as the container 10 of FIGS. 1-2. These features are labeled with the same reference numerals as corresponding features of the container 10 of FIGS. 1-2. For example, as shown in FIGS. 4-5 and 14-15, junctures 19 between the handle 86 and the pouch 112, at the lowest locations 71, 72 (of which only 71 is visible in FIGS. 14-15) of the opening 76, are not above, but instead below, the bottom 51 of the fitment's adjoining section 50 and the bottom 55 of the fitment 14. The container 110, when suspended by the handle 16, lacks a line of material, supporting the weight of pouch's contents 11, extending continuously downward from the handgrip structure 86 to the fitment 14.

Figure 16:
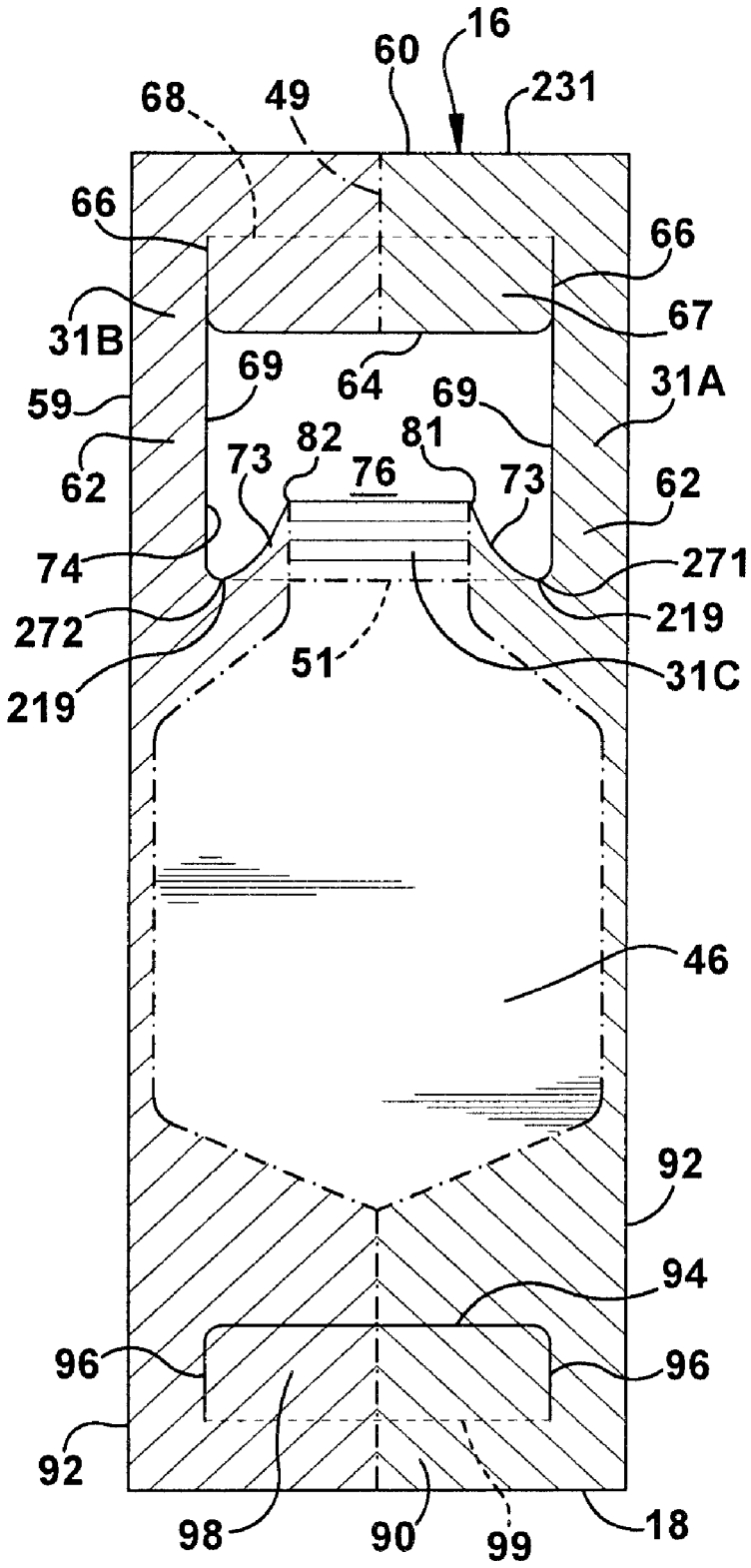
FIG. 16 is a view, similar to FIG. 4, of an alternative front panel.

In each panel 31, 32, 41, 42 described above, as illustrated with reference to the front panel 31 of FIG. 4, the handle junctures 19 at the lowest points 71, 72 of the panel opening 76 are below the fitment's adjoining section 50. FIG. 16 shows an alternative front panel 231, in which the junctures 219 and the lowest points 271, 272 of the panel opening 76 are at, instead of below, the level of the bottom 51 of the fitment's adjoining section 50. This is indicated by two horizontal dashed lines extending from the lowest points 271, 272 to the bottom 51 of the fitment's adjoining section 50. The front panel 231 can be joined to an identical rear panel and the fitment 14 to yield an alternative container. All other features of the front panel 231 of FIG. 16 are the same as in the front panel 31 of FIG. 4, and are labeled with the same reference numerals as the corresponding features of FIG. 4.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have elements that do not differ from the literal language of the claims, or if they include equivalent elements with insubstantial differences from the literal language of the claims.

The invention claimed is:

1. A flexible container comprising:

a panel structure of flexible web material, defining a pouch that has a top opening;

a closure cap;

a rigid fitment in the top opening, having a surface section at which the fitment is sealed to the pouch, and further having a fitment opening through which contents of the pouch can be emptied from the pouch, and configured for the cap to be removably secured to the fitment to close off the fitment opening; and a handle, defined by the panel structure, by which the pouch is configured to be carried in an upright orientation in which the handle projects upward from the pouch at a juncture that is not above the bottom of the sealed surface section of the fitment;

wherein the handle includes a handgrip and suspensions with lengths reaching vertically from the handgrip to the pouch;

wherein the panel structure includes a front panel, a rear panel, and laterally opposite first and second side panels adjoining the front and rear panels throughout the lengths of the suspensions; and wherein the handgrip has a midline, the side panels have handle sections that are folded in half at respective fold lines, and the fold lines meet at the midline of the handgrip.

2. The container of claim 1 wherein the front panel adjoins the rear panel within the handgrip only at the midline.

3. The container of claim 1 wherein the front, rear and side panels have respective flap sections that together form a flap portion of the handgrip, with the flap portion located beside a fold line about which the handgrip is foldable onto itself to increase the thickness of the handgrip.

4. The container of claim 1 wherein the side panels are defined by two panels of flexible web material that are substantially identical to each other.

5. The container of claim 1 wherein the front panel, the rear panel, and the side panels are defined by four panels of flexible web material that are substantially identical to each other.

* * * * *